US008617006B2

(12) United States Patent
VanDelden

(10) Patent No.: US 8,617,006 B2
(45) Date of Patent: Dec. 31, 2013

(54) ADAPTIVE GOLF BALL

(76) Inventor: Jay VanDelden, Trumansburg, NY (US)

( * ) Notice: Subject to any disclaimer, the term of this patent is extended or adjusted under 35 U.S.C. 154(b) by 0 days.

(21) Appl. No.: 13/152,730

(22) Filed: Jun. 3, 2011

(65) Prior Publication Data

US 2011/0250993 A1 Oct. 13, 2011

Related U.S. Application Data

(62) Division of application No. 12/704,976, filed on Feb. 12, 2010, now Pat. No. 7,976,407, which is a division of application No. 11/842,588, filed on Aug. 21, 2007, now Pat. No. 7,682,265.

(60) Provisional application No. 60/838,842, filed on Aug. 21, 2006.

(51) Int. Cl.
*A63B 57/00* (2006.01)

(52) U.S. Cl.
USPC ..... 473/409

(58) Field of Classification Search
USPC ..... 473/409
See application file for complete search history.

(56) References Cited

U.S. PATENT DOCUMENTS

| | | | |
|---|---|---|---|
| 638,920 | A | 12/1899 | Grant |
| 1,493,687 | A | 5/1924 | Lowell |
| 1,670,627 | A | 5/1928 | Lowell |
| 2,200,257 | A | 5/1940 | Bogoslowsky |
| 3,054,615 | A | 9/1962 | Budish |
| 3,404,892 | A | 10/1968 | Pearce |
| 3,466,049 | A | 9/1969 | Fox et al. |
| 3,738,655 | A | 6/1973 | Feddick et al. |
| 3,891,221 | A | 6/1975 | Gordon |
| 3,897,059 | A | 7/1975 | McCulloch et al. |
| 3,995,865 | A | 12/1976 | Cochran et al. |
| 4,142,720 | A | 3/1979 | Davis |
| 4,178,707 | A | 12/1979 | Littlefield |
| 4,485,024 | A | 11/1984 | Furumura et al. |
| 4,496,395 | A | 1/1985 | Croat |
| 4,597,938 | A | 7/1986 | Matsuura et al. |
| 4,762,322 | A | 8/1988 | Molitor et al. |
| 4,805,914 | A | 2/1989 | Toland |
| 4,837,109 | A | 6/1989 | Tokunaga et al. |
| 5,033,749 | A | 7/1991 | Kakiuchi et al. |
| 5,132,622 | A | 7/1992 | Valentino |

(Continued)

FOREIGN PATENT DOCUMENTS

| | | | |
|---|---|---|---|
| DE | 102 17 370 | A1 | 11/2003 |
| GB | 2 201 100 | A | 8/1988 |

(Continued)

OTHER PUBLICATIONS

"Ancient Spheres," *Golf Magazine* 34(4):178 (1992).

(Continued)

*Primary Examiner* — Raeann Gorden
(74) *Attorney, Agent, or Firm* — Nixon Peabody LLP

(57) ABSTRACT

The present invention relates to a smart golf ball comprised of one or more mantle layers juxtaposed between an inner core and outer cover, where the core, the mantle layer(s), and/or the cover are further comprised of a ferrofluid, a magnetorheological fluid, an inverse magnetorheological fluid, and/or a magnetorheological elastomer, in any of its construction. These nano-engineered materials make possible a golf ball with heretofore-unprecedented levels of adaptive play.

12 Claims, 3 Drawing Sheets

(56) References Cited

U.S. PATENT DOCUMENTS

| | | | | |
|---|---|---|---|---|
| 5,167,850 | A | 12/1992 | Shtarkman | |
| 5,184,828 | A | 2/1993 | Kim et al. | |
| 5,312,105 | A | 5/1994 | Cleveland | |
| 5,322,756 | A | 6/1994 | Ziolo | |
| 5,390,930 | A | 2/1995 | Hu et al. | |
| 5,403,006 | A | 4/1995 | Korte-Jungermann | |
| 5,439,227 | A | 8/1995 | Egashira et al. | |
| 5,467,994 | A | 11/1995 | Moriyama et al. | |
| 5,480,155 | A | 1/1996 | Molitor et al. | |
| 5,482,282 | A | 1/1996 | Willis | |
| 5,556,098 | A | 9/1996 | Higuchi et al. | |
| 5,580,057 | A | 12/1996 | Sullivan et al. | |
| 5,597,365 | A | 1/1997 | Yamada et al. | |
| 5,601,502 | A | 2/1997 | Hiraoka et al. | |
| 5,628,699 | A | 5/1997 | Maruko et al. | |
| 5,674,137 | A | 10/1997 | Maruko et al. | |
| 5,683,312 | A | 11/1997 | Boehm et al. | |
| 5,803,831 | A | 9/1998 | Sullivan et al. | |
| 5,823,887 | A | 10/1998 | Mikame et al. | |
| 5,836,831 | A | 11/1998 | Stanton et al. | |
| 5,851,160 | A | 12/1998 | Rugge et al. | |
| 5,885,172 | A | 3/1999 | Hebert et al. | |
| 5,919,100 | A | 7/1999 | Boehm et al. | |
| 6,056,889 | A | 5/2000 | Tsuda et al. | |
| 6,068,785 | A | 5/2000 | Raj et al. | |
| 6,093,112 | A | 7/2000 | Peters et al. | |
| 6,174,245 | B1 | 1/2001 | Stanton et al. | |
| 6,231,452 | B1 | 5/2001 | Novosel, Sr. | |
| 6,251,030 | B1 | 6/2001 | Kato et al. | |
| 6,287,216 | B1 | 9/2001 | Boehm | |
| 6,299,550 | B1 | 10/2001 | Molitor et al. | |
| 6,302,939 | B1 | 10/2001 | Rabin et al. | |
| 6,315,680 | B1 | 11/2001 | Dalton et al. | |
| 6,325,730 | B1 | 12/2001 | Binette et al. | |
| 6,514,157 | B2 * | 2/2003 | Jordan et al. | 473/354 |
| 6,595,874 | B2 | 7/2003 | Sullivan et al. | |
| 6,616,549 | B2 | 9/2003 | Dalton et al. | |
| 6,648,777 | B2 | 11/2003 | Kennedy, III et al. | |
| 6,712,487 | B2 | 3/2004 | Liou | |
| 6,794,447 | B1 | 9/2004 | Kim et al. | |
| 6,794,472 | B2 | 9/2004 | Harris et al. | |
| 6,860,819 | B2 | 3/2005 | Gilbert | |
| 6,976,925 | B2 | 12/2005 | Owens et al. | |
| 7,041,007 | B2 | 5/2006 | Boehm et al. | |
| 7,115,044 | B2 | 10/2006 | Faltin | |
| 7,160,209 | B2 | 1/2007 | Marotta et al. | |
| 7,682,265 | B2 | 3/2010 | VanDelden | |
| 2005/0009438 | A1 | 1/2005 | Chojnacki et al. | |
| 2005/0085316 | A1 | 4/2005 | Barr | |
| 2006/0105861 | A1 | 5/2006 | Yang | |
| 2006/0148590 | A1 | 7/2006 | Sullivan et al. | |
| 2006/0252569 | A1 * | 11/2006 | Carter | 473/281 |
| 2007/0049396 | A1 | 3/2007 | Scheibe | |
| 2008/0220899 | A1 | 9/2008 | Sullivan et al. | |

FOREIGN PATENT DOCUMENTS

| | | | |
|---|---|---|---|
| JP | 1160573 | A | 6/1989 |
| JP | 2004033327 | A | 2/2004 |
| JP | 2005006805 | A | 1/2005 |

OTHER PUBLICATIONS

"Rules of Golf" *R&A Rules Limited and the United States Golf Association* 30th Edition (Jan. 2004).

Borcea & Bruno, "On the Magneto-elastic Properties of Elastomer-Ferromagnet Composites," *Journal of the Mechanics and Physics of Solids* 49:2877-2919 (2001).

Braham, "All this for a Golf Ball?" *Machine Design* 63(25):121-126 (1991).

Carlson et al., "Commercial Magneto-Rheological Fluid Devices," at http://mutualhosting.com/~lordfulfillment/upload/LL8001.pdf, 5th Int. Conf. on Electro-Rheological, Magneto-Rheological Suspensions and Associated Technology, Sheffield (Jul. 10-14, 1994).

Cicon, "Build a Magnetic Ball Levitator," *Popular Electronics* 13(5):48 (May 1996).

Coey, "Permanent Magnetism," *Solid State Communications* 102(2-3):101-105 (1997).

Corneliussen, "Golf Balls—From Cover to Core," *Plastics Engineering* (Apr. 2005).

Croat et al., "High-Energy Product Nd-Fe-B Permanent Magnets," *Appl. Phys. Lett.* 44(1):148-149 (1984).

Cross, "The Bounce of a Ball," *Am. J. Phys.* 67(3):222-227 (1999).

Dorfmann & Ogden, "Magnetoelastic Modeling of Elastomers," *European Journal of Mechanics A/Solids* 22:497-507 (2003).

Genc & Phule, "Rheological Properties of Magnetorheological Fluids," *Smart Mater. Struct.* 11:140-146 (2002).

Gorss, "Polymer Chemistry has Played a Key Role in the Evolution of the Golf Ball," *Chemical and Engineering News* 83(29):34 (Jul. 2005).

Hoon & Tanner, "Magnetic Fluids—part 1," *Phys. Educ.* 20:61-65 (1985).

Hoon & Tanner, "Magnetic Fluids—part 2," *Phys. Educ.* 20:120-123 (1985).

International Search Report for International Patent Application No. PCT/US07/76372 (Sep. 26, 2008).

Jiles, "Recent Advances and Future Directions in Magnetic Materials," *Acta Materialia* 51:5907-5939 (2003).

Johnson, "Mortally Wounded?" *Golf Digest* (Jun. 2001).

Jolly et al., "Properties and Applications of Commercial Magnetorheological Fluids," *Journal of Intelligent Material Systems and Structures* 10(1):5 (1999).

Klingenberg, "Making Fluids into Solids with Magnets," *Scientific American* pp. 112-113 (Oct. 1993).

Lane & Craig, "Materials that Sense and Respond: An Introduction to Smart Materials," *The AMPTIAC Quarterly* 7(2):9-14 (2003).

Magnetic Golf Solutions, Inc., "With a Mag-Grip, Magnetic Putter Grip and Magnetic Putter Cover," at http://www.magneticgolfsolutions.com/DiamondPutters.html (Retrieved from the internet on Jun. 4, 2007).

Penner, "The Physics of Golf: The Optimum Loft of a Driver," *Am. J. Phys.* 69(5):563-568 (2001).

Ponomarenko et al., "Magnetic-field-sensitive Polymer Composite Materials," *Smart Mater. Struct.* 3:409-415 (1994).

Popplewell & Rosensweig, "Magnetorheological Fluid Composites," *J. Phys. D: Appl. Phys.* 29:2297-2303 (1996).

Popplewell et al., "Magnetorheology of Ferrofluid Composites," *Journal of Magnetism and Magnetic Materials* 149:53-56 (1995).

Raj et al., "Advances in Ferrofluid Technology," *Journal of Magnetism and Magnetic Materials* 149:174-180 (1995).

Rasa et al., "Initial Susceptibility, Flow Curves, and Magneto-Optics of Inverse Magnetic Fluids," *Phys. Rev. E* 68:031402-1-16 (2003).

Rogers, "Intelligent Materials," *Scientific American* 273(3):154-157 (1995).

Rosensweig, "Buoyancy and Stable Levitation of a Magnetic Body Immersed in a Magnetizable Fluid," *Nature* 210:613-614 (1966).

Rosensweig, "Magnetic Fluids," *Ann. Rev. Fluid Mech.* 19:437-463 (1987).

Saldivar-Guerrero et al., "Liquid to Solid Transition of Inverse Ferrofluids," *The 15th RIGA and 6th PAMIR Conference on Fundamental and Applied MHD* 365-368 (2005).

Simon et al., "Diamagnetically Stabilized Magnet Levitation," *Am. J. Phys.* 69(6):702-713 (2001).

Simon et al., "Spin Stabilized Magnetic Levitation," *Am. J. Phys.* 65(4):286-292 (1997).

Stachura, "Cutting to the Core: Should your next Ball be Two-piece or Multilayer? We Sort out the Spin to Help you Find the Right One—Golf Balls," *Golf Digest* (Sep. 2003).

Stanway, "Smart Fluids: Current and Future Developments," *Mater. Sci. Tech.* 20:931-939 (2004).

Stinson, "Plastic Mends its Own Cracks," *Chemical & Engineering News* 79(8):13 (Feb. 2001).

(56) References Cited

OTHER PUBLICATIONS

Tadmor et al., "Resolving the Puzzle of Ferrofluid Dispersants," *Langmuir* 16(24):9117-9120 (2000).
Valenta, "The Singular History of the Golf Tee," Greensboro, N.C. (1995).
Wang & Hu, "Magnetorheological Elastomers Based on Isobutylene-Isoprene Rubber," *Polymer Engineering and Science* 264-268 (2006).
Wang & Meng, "Magnetorheological Fluid Devices: Principles, Characteristics and Applications in Mechanical Engineering," *Proc. Instn. Mech. Engrs.* 215(Part L):165-174 (2001).
White et al., "Autonomic Healing of Polymer Composites," *Nature* 409:794-797 (2001); Nature 415:817 (2002).
Williams, "Electromagnetic Levitator," *Electronics Now* 67(2):33 (Feb. 1996).
Written Opinion of the International Searching Authority for International Patent Application PCT/US07/76372 (Aug. 28, 2008).

* cited by examiner

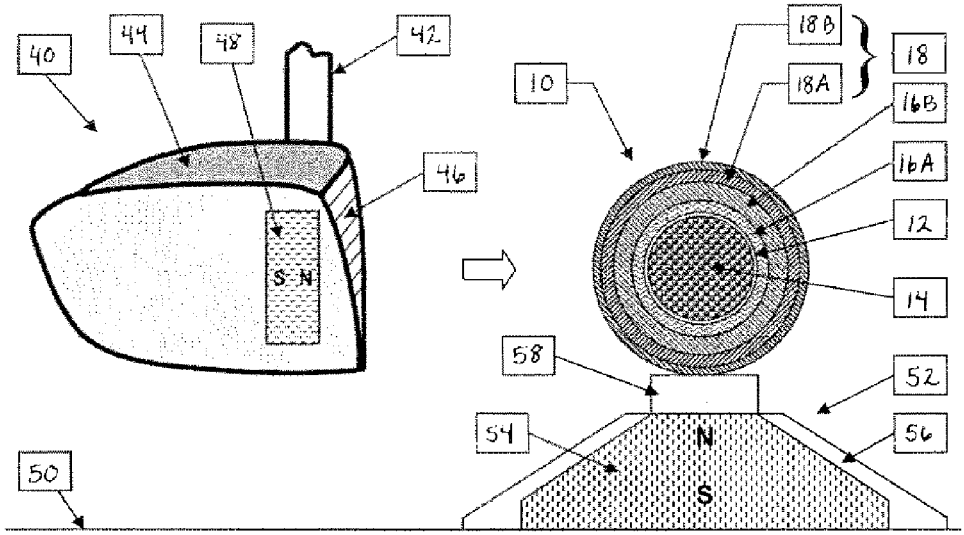
Figure 1
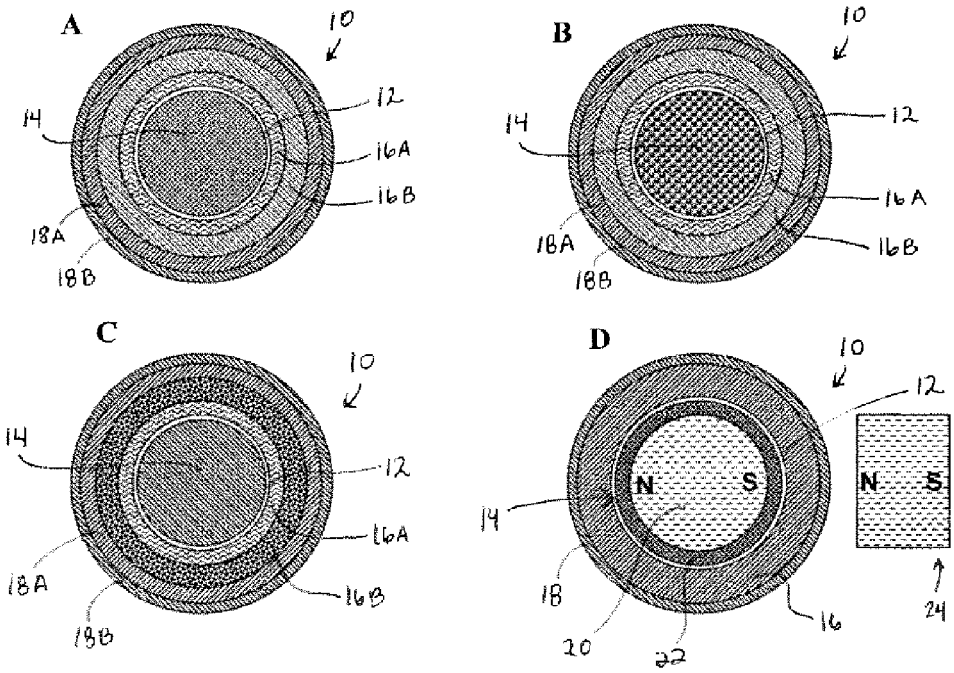
Figures 2A-D

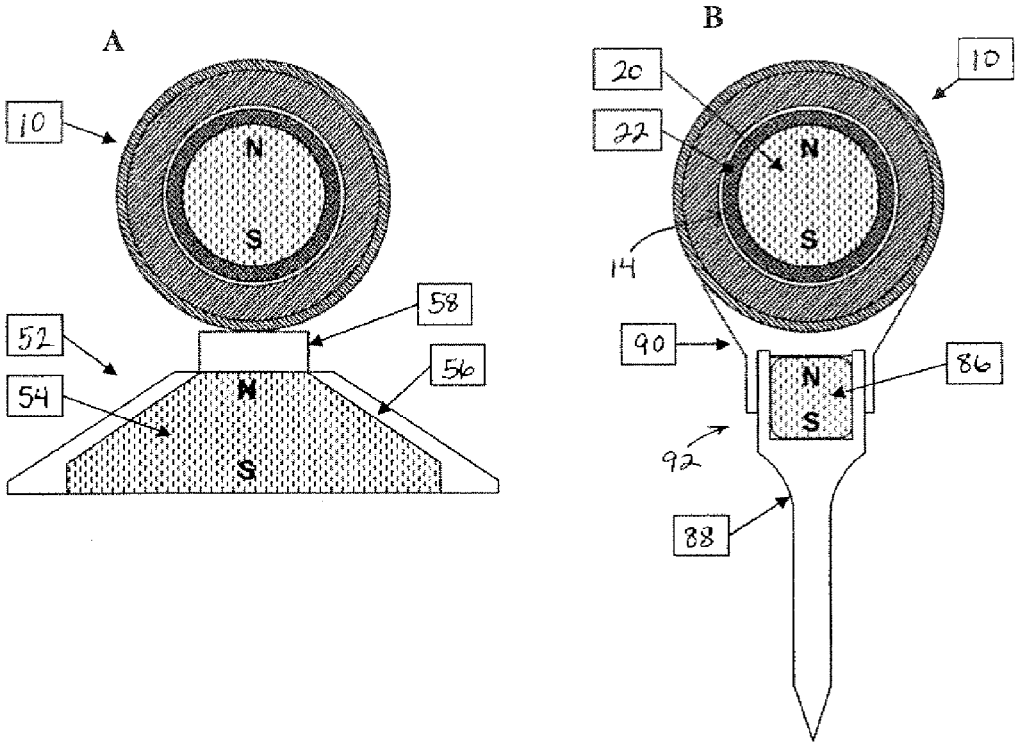
Figures 3A-B
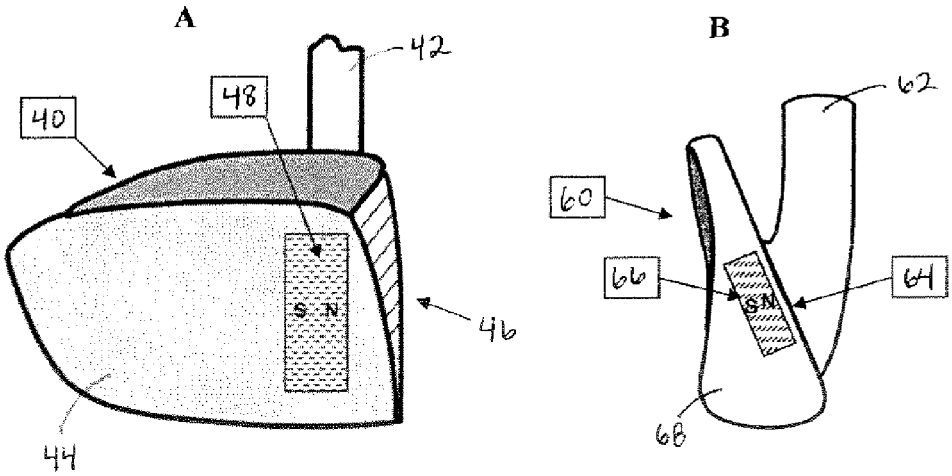
Figures 4A-B

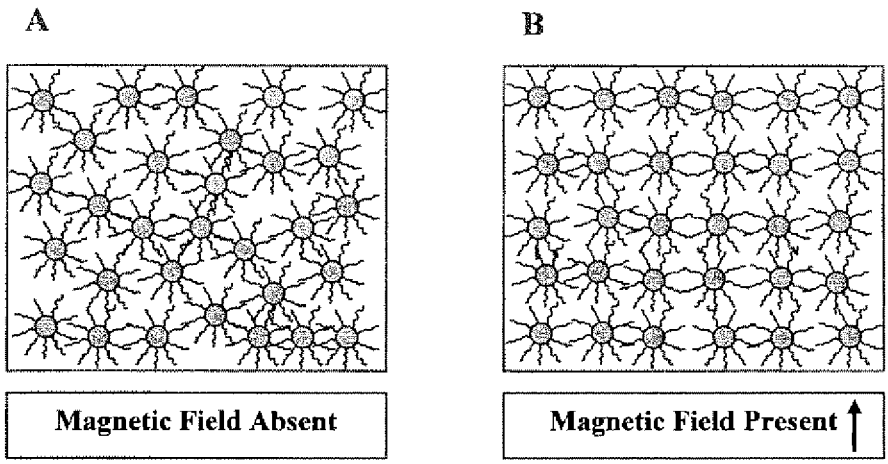
Figures 5A-B
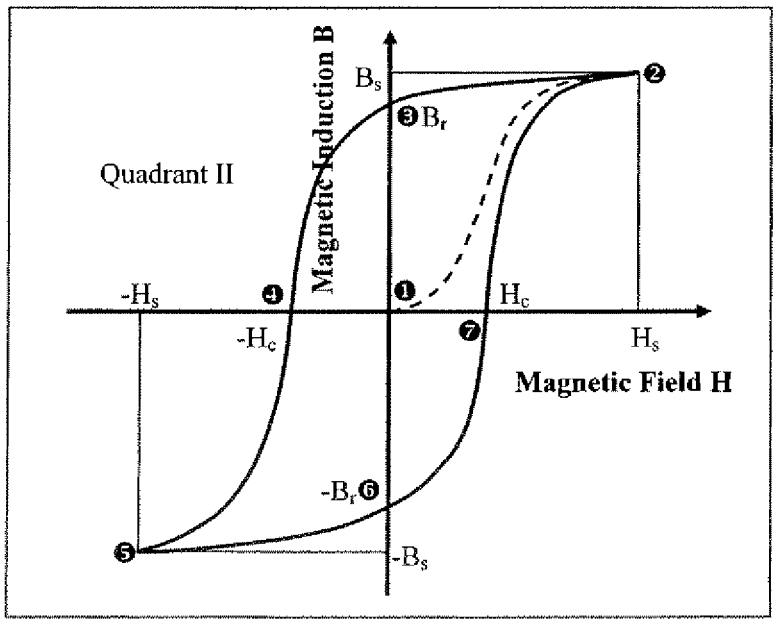
Figure 6

ADAPTIVE GOLF BALL

This application is a division of U.S. patent application Ser. No. 12/704,976, filed Feb. 12, 2010, which is a division of U.S. patent application Ser. No. 11/842,588, filed Aug. 21, 2007, now U.S. Pat. No. 7,682,265. which claims the priority benefit of U.S. Provisional Patent Application No. 60/838,842, filed Aug. 21, 2006, which are hereby incorporated by reference in their entirety.

FIELD OF THE INVENTION

The present invention relates generally to golf balls, and more particularly to an adaptive golf ball that employs a ferrofluid, a magnetorheological fluid, an inverse magnetorheological fluid, and/or a magnetorheological elastomer, in any of its construction, for enhancing the ball's playability.

BACKGROUND OF THE INVENTION

A long-standing goal of the golf ball design and manufacturing community is to select the various design parameters of a golf ball to optimally address its playability whilst satisfying all of the United States Golf Association ("USGA") Rules of Golf. According to USGA regulations, the weight of a golf ball cannot exceed 1.620 ounces (avoirdupois), nor can the diameter of the ball be less then 1.680 inches. The USGA further stipulates that the initial velocity of the golf ball cannot exceed 255 feet per second and the driver distance must be less than 320 yards, both under controlled hitting conditions with a mechanical golfer. And finally, a golf ball must be spherically symmetric.

For many years, "the undisputed champion of performance golf balls featured rubber-windings wrapped around a liquid-filled core" (Johnson, "Mortally Wounded: Hot, New Solid-Core Balls Have Nearly KO'd Their Wound-Ball Rivals," *Golf Digest*, June 2001). A superlative example of the three-piece, "liquid-center, thread-wound golf ball" is described in U.S. Pat. No. 5,597,365 to Yamada et al. Today, one is hard-pressed to find any so-called "wound" golf balls on the market. New materials and modernized manufacturing processes (in combination with certain market trends and other economic forces) have nearly forced the three-piece, wound golf ball into obsolescence.

With few exceptions, most golf balls fall into one of three different categories:

(1) Two-Piece, Solid-Core;

(2) Multi-Layer, Solid-Core; or (3) Multi-Layer, Liquid-Core.

Category 1 balls (Two-Piece, Solid-Core) are typically constructed of a rubber-like polymeric core, surrounded by a thermoplastic ionomer cover. Examples of this ball include the Top-Flite XL (Top-Flite Golf Company, Carlsbad, Calif.) and the Titleist DT SoLo (Acushnet Company, Fairhaven, Mass.). Although these balls are easier to manufacture, due in-part to their economy of design, they are considered by some to have limited playing characteristics with regard to feel and spin.

Category 2 balls (Multi-Layer, Solid-Core) typically have one or more solid (i.e., "non-wound") mantle layers juxtaposed between a solid inner core and outer cover. More often than not, the core material is made of polybutadiene, or a close relative, and the cover is constructed of a thermoplastic-ionomer inner cover and a castable urethane outer cover. Examples of this ball include the Srixon Z-URS (Sumitomo Rubber Industries, Ltd., Hyogo-ken. Japan) and the Nike One Platinum (Nike Inc., Beaverton, Oreg.).

Category 3 balls (Multi-Layer, Liquid-Core) are typically constructed of one or more solid (i.e., "non-wound") mantle layers juxtaposed between a liquid core and outer cover. Examples of this construction are disclosed in U.S. Pat. No. 5,919,100 to Boehm et al. and U.S. Pat. No. 6,299,550 to Molitor et al.

Arguably, some golf balls fall outside of these traditional categories. For example, U.S. Pat. No. 6,976,925 to Owens et al. describes a golf ball with a hollow-steel-core, surrounded by an intervening mantle layer and ionomer cover.

To date, golf ball designers and manufacturers have advanced the art of golf ball fabrication by ingenious construction geometry and a judicious selection of materials. However, there is a certain class of materials that have been largely overlooked by the golf ball design and manufacturing community. These so-called "smart" or "intelligent" materials exhibit a change in certain material properties as a function of some externally applied stimulus (see Rogers, "Intelligent Materials," *Scientific American*. September 1995, pp. 154-157).

In what might be the first golf ball implementation of a smart material, U.S. Pat. No. 6,794,472 to Harris et al. describes the use of a "self-healing" polymer to autonomously improve the durability of a golf ball. In a method that was first reported by White et al., "Autonomic Healing of Polymer Composites" *Nature* 409:794-797 (2001), microencapsulated healing agents are released upon crack intrusion. U.S. Pat. No. 6,794,472 to Harris et al. contends that these healing agents will enable a golf ball to automatically mend micro-cracks that occur during play. Although this self-healing mechanism might increase the longevity of a golf ball, it does little to impact the ball's playability. In other words, a player's handicap is typically not influenced by the longevity of a golf ball.

Accordingly, there exists a need for a paradigm shift in the design and manufacture of golf balls that employ smart, nano-engineered materials to elevate the performance of play.

SUMMARY OF THE INVENTION

The present invention relates to a smart golf ball containing one or more mantle layers juxtaposed between an inner core and outer cover, where the core, the mantle layers, and/or the cover have a ferrofluid, a magnetorheological fluid, an inverse magnetorheological fluid, and/or a magnetorheological elastomer, in any of its construction. The resulting adaptive golf ball allows heretofore-unprecedented levels of playability and/or manufacturability.

In one preferred embodiment of the present invention, an adaptive golf ball is comprised (in-part) of a ferrofluid core, where the ferrofluid is further comprised of a colloidal suspension of nanometer-sized, magnetic particles immersed in a carrier liquid. Application of a magnetic field to the ferrofluid core will alter certain material properties of the core, thereby changing the playability and/or manufacturability of the ball.

In another preferred embodiment of the present invention, an adaptive golf ball is comprised (in-part) of a magnetorheological fluid core, where the magnetorheological fluid is further comprised of a non-colloidal suspension of micrometer-sized, magnetizable particles immersed in a carrier liquid. Application of a magnetic field to the magnetorheological fluid core will alter certain material properties of the core, thereby changing the playability and/or manufacturability of the ball.

In another preferred embodiment of the present invention, an adaptive golf ball is comprised (in-part) of an inverse magnetorheological fluid core, where the inverse magnetorheological fluid is further comprised of a composite suspension of micrometer-sized, non-magnetic particles and nanometer-sized, magnetic particles, both immersed in the same carrier liquid. Application of a magnetic field to the inverse magnetorheological fluid core will alter certain material properties of the core, thereby changing the playability and/or manufacturability of the ball.

In yet another preferred embodiment of the present invention, an adaptive golf ball is comprised (in-part) of a magnetorheological elastomer mantle layer, where the magnetorheological elastomer is further comprised of a distribution of magnetic and/or magnetizable particles suspended in a polymer matrix. Application of a magnetic field to the magnetorheological elastomer will alter certain material properties of the mantle layer, thereby changing the playability and/or manufacturability of the ball.

In still yet another preferred embodiment of the present invention, an adaptive golf ball is comprised (in-part) of a magnetic core, where the magnetic core is further comprised of a "floating" permanent magnet that is magnetically-levitated and self-centered within a spherical liquid shell of ferrofluid and/or inverse magnetorheological fluid, to allow the core to spin independently from the cover, thereby changing the playability and/or manufacturability of the ball.

Whatever the specific embodiments may be, golf balls conforming to the present invention include any ball that employs a magnetic fluid and/or magnetic elastomer in any of its construction, to facilitate one or more of the following advantages over prior art:

1. Magnetorheological fluids exhibit semi-solid-like characteristics in the presence of a magnetic field and semi-liquid-like characteristics in the absence of one. As a result, when an adaptive golf ball (with a magnetorheological fluid core) is resting upon a magnetic golf tee (i.e., a golf tee with one or more permanent magnets integrated therein), it will exhibit a solid core with reduced spin and greater distance off the tee. In the fairway and on the green however (i.e., without the use of a golf tee, magnetic or otherwise), this same adaptive golf ball will exhibit a liquid core with greater spin and improved control. In this way, the same ball will exhibit markedly-different playing characteristics depending on the use, or not, of a magnetic golf tee.

2. When an adaptive golf ball is struck by a magnetic golf club (i.e., a golf club with one or more permanent magnets integrated therein), it will react differently as compared to being struck by a conventional (i.e., non-magnetic) golf club. In this way, the same adaptive golf ball will allow a more sophisticated club selection for the shot at hand.

3. Use of a magnetic golf club with one or more permanent magnets integrated immediately-behind and centered-upon the optimal hitting region of the club face, may statistically reduce the number of mis-hits, because an adaptive golf ball will be attracted towards the "sweet" area of the club face immediately before impact (i.e., the golf ball will be struck more often by the optimal region of the club face).

4. The magnitude of interaction between an adaptive golf ball and a magnetic golf club and/or magnetic golf tee can be easily controlled by the strength and number of permanent magnets integrated into the club and/or the tee. In this way, one may achieve magnetically-tunable playability. This would allow golf ball manufacturers to market the same ball over a much wider audience. "The adaptive golf ball could be the last ball you (the player) will ever use."

5. An adaptive golf ball may enjoy certain advantages with regard to the various energy and momentum conservation, transference, and/or conversion mechanisms normally associated with the process of striking a golf ball with a golf club.

6. An adaptive golf ball may be more amenable to future technological innovations in the game of golf. For example, should an electromagnetic grid be someday buried beneath the playing surface, it might be possible to map the trajectory and impact point of an adaptive golf ball, to track player statistics in real time.

7. Without a magnetic field present to invoke its extraordinary behavior, the adaptive golf ball will play like an ordinary golf ball. As a result, the novice player is not penalized for not invoking its special properties.

8. An adaptive golf ball with a magnetorheological elastomer core, mantle, and/or cover layer will exhibit a unique, machine-readable, difficult to duplicate, three-dimensional distribution of magnetic and/or magnetizable particles. This distribution can be used as a unique magnetic "fingerprint" or "signature" for players and officials to unequivocally differentiate one golf ball from another.

9. An adaptive golf ball can be conveniently picked-up using a permanent magnet that is attached or otherwise integrated into one or the other distal end of a putter. This may alleviate back strain or injury when leaning over to pick-up the ball after sinking a putt.

10. Use of a permanent magnet at the distal end of a long, telescopic pole may facilitate the retrieval of an adaptive golf ball in murky water and/or uninviting brush.

11. As an aid for physically-handicapped players, a magnetic cup (i.e., a cup on the green with permanent magnets integrated therein and/or thereon) could be used to attract an adaptive golf ball with a statistical reduction in the number of strokes on the green.

12. A magnetic golf tee (i.e., a golf tee with one or more permanent magnets integrated therein) will be easier to use with an adaptive golf ball as compared to the "balancing act" of a conventional golf ball resting on a conventional golf tee.

13. On a driving range, where the need exists to pick-up a large number of golf balls in a quick and efficient manner, an adaptive golf ball could facilitate a magnetic "raking" means for picking up many golf balls simultaneously.

14. An adaptive golf ball may allow for certain manufacturing advantages. For example, the liquid-core of a traditional golf ball is sometimes frozen to retain its spherical shape during subsequent processing steps. In comparison, a magnetorheological fluid core could be "solidified" by merely introducing a magnetic field and then "re-liquefied" at some later convenient time by removing the magnetic field.

15. In a production environment, the adaptive golf bail will enjoy certain handling, holding, sorting and/or packaging advantages, because a permanent magnet and/or electro-magnet can be used to pick-up and place one or more of them in a novel and convenient manner.

16. An adaptive golf ball may have certain advantages with regard to labeling. For example, certain inks and paints are now available with magnetic particles contained therein. It may be possible that these magnetic pigments will adhere more favorably to the surface of an adaptive golf ball, thereby allowing the manufacturer's name and other labeling (part number, serial number, etc.) to last longer.

17. Recently, hollow-metal-core golf balls have gained a following amongst some players because of their favorable moment of inertia characteristics (see Nano Dynamics NDMX HMS110, which is hereby incorporated by reference in its entirety). An adaptive golf ball could be simply achieved by filling the hollow-core with a magnetic fluid.

18. Traditional golf tees are considered by most to be low-tech, expendable necessities of the game. As a result, most golf ball manufacturers do not fabricate them. An adaptive golf ball would cause the golf tee to evolve from its present unsophisticated state, thereby enticing golf ball manufacturers to increase their revenues by selling magnetic golf tees.

19. If a reservoir of ferrofluid should take the shape of a sphere, and a permanent magnet in spherical form be introduced therein, the magnet will float towards the center of the reservoir. Such magnetic-levitating and self-centering means may have profound advantages in the core of an adaptive golf ball because it effectively de-couples the spin aptitude of the cover from the core.

20. During manufacture, retractable pins are traditionally used to center the core within the overlying mantle layer(s) and/or cover. This procedure leaves material voids behind, that need to be later filled-up in subsequent processing steps. In theory, magnetic levitation could be used to position the core of an adaptive golf ball during such time that the mantle layer(s) and/or cover are being formed, thereby allowing a higher level of centration to be achieved without the use of retractable holding pins.

21. As is well known by those who are fluent in spin-stabilized magnetic levitation, a spinning magnet can sometimes be suspended in mid-air above a permanent magnet. An adaptive golf ball with a floating magnetic core could facilitate such levitation means.

22. An adaptive golf ball will continue to benefit from the exponential growth in maximum energy product ($BH_{max}$) for permanent magnet materials.

23. After club impact, a spinning adaptive golf ball (with a floating magnetic core) may enjoy certain advantages with regard to its flight as a result of the earth's magnetic field.

BRIEF DESCRIPTION OF THE DRAWINGS

Further features and advantages of the invention are imbued in the drawings described below, and the detailed description that follows thereafter.

FIG. 1 is an illustration depicting an adaptive golf ball according to one embodiment of the present invention, including a magnetic golf club (i.e., a magnetic driver) and a magnetic golf tee.

FIGS. 2A-D are cross-sectional illustrations depicting several embodiments of an adaptive golf ball according to the present invention.

FIGS. 3A-B are cross-sectional illustrations depicting different embodiments of a magnetic golf tee to be used for supporting an adaptive golf ball according to the present invention.

FIGS. 4A-B are illustrations depicting different embodiments of a magnetic golf club to be used for striking an adaptive golf ball according to the present invention.

FIGS. 5A-B are illustrations depicting a magnetic fluid in the absence and presence of a magnetic field.

FIG. 6 is a graph depicting the induction (hysteresis) curve of a typical ferromagnetic material.

DETAILED DESCRIPTION OF THE INVENTION

A fundamental objective of golf ball manufacturers is to select the various design parameters of a golf ball to optimally address its playability over a wide range of player preferences and conditions.

As used herein and throughout, the term "design parameters" of a golf ball shall include, but not be limited to, their weight (including their distribution of weight), geometry (diameter, layer radii, etc.), material composition (core, cover, mantle layers, interstitial layers, adhesives, fillers, curing agents, mold-release agents, etc.), compression (PGA, Riehle, or other), flexural modulus, tensile strength, yield strength, density (i.e., specific gravity), elongation, viscosity (Mooney or other). elasticity, hardness (Shore D or other), resilience, vibration impedance, abrasion (i.e., scuff) resistance, surface structure (i.e., dimple pattern), moment of inertia, coefficient of restitution, aerodynamics (i.e., lift and drag), color (i.e., pigmentation), surface coatings, and surface labeling, among other things.

As used herein and throughout, the term "playability" shall include, but not be limited to, distance (carry and roll), spin, control, feel, click, bite, grab, and/or any other desirable feature of golf ball play.

Taken in the context of a typical round of golf, a golf ball is a sophisticated physical system that must endure ever-changing player preferences and conditions. Sometimes the player prefers increased distance and less spin. Sometimes the player prefers increased spin and less distance, etc. Sometimes the course conditions are hot and dry. Sometimes the course conditions are cold and wet, etc. All things considered, it remains a challenging task for golf ball manufacturers to engineer the design parameters of a golf ball for optimal playability at all times.

An important new class of materials is emerging that will someday transform the art of golf ball design. These so-called smart materials will allow golf balls to adaptively change their playability from hole-to-hole or shot-to-shot as the needs of the player change.

As used herein and throughout, the term "smart materials" shall refer to a class of materials that exhibit a change in one or more of their material properties as a function of some externally-applied stimulus. In the context of the present invention, these smart materials will be comprised of magnetic fluids and/or magnetic elastomers whose properties are changed by applying an external magnetic field.

Preferably, but not necessarily, magnetic fluids will be further comprised of ferrofluids, magnetorheological fluids, and/or inverse magnetorheological fluids.

Preferably, but not necessarily, magnetic elastomers will be further comprised of magnetorheological elastomers, ferroelastomers, and/or magneto-elastic polymers.

Because the playability of a golf ball is inextricably linked to the materials of which it is composed (and their associated material properties), it is recognized that a golf ball that utilizes smart materials in its construction (a so-called "smart golf ball") will exhibit a change in its playability as a function of some externally-applied stimulus.

As used herein and throughout, the term "smart golf ball" shall refer to a golf ball that employs one or more smart materials in its construction.

The novelty of the present invention resides in the incorporation of a smart material in the construction of a golf ball with enhanced playability and/or manufacturability resulting. More particularly, the novelty of the present invention resides in the incorporation of a magnetic fluid and/or a magnetic elastomer in the construction of an adaptive golf ball that addresses the varying needs of the player (i.e., less-spin/more distance or more-spin/less distance) in an adaptive manner, thereby facilitating heretofore-unprecedented levels of golf ball play.

Club-Ball Interaction Physics

The physical interaction between a golf club and a golf ball can be understood in-part from simple energy considerations. Conservation of energy requires that the sum total of kinetic energy ("KE") plus potential energy ("PE") of the club-ball system remain constant such that $[KE^b_c - KE^a_c] = KE_b + PE_b$, where $KE^b_c$ ($KE^a_c$) is the kinetic energy of the golf club before (after) impact and $KE_b$ ($PE_b$) is the kinetic (potential) energy of the golf ball after impact. As a golf ball is being struck, the change in kinetic energy of the golf club is converted into both kinetic and potential energy of the golf ball. The kinetic energy of the golf ball can be further separated into translational and rotational terms such that $KE_b=KE^t_b+KE^r_b$. The translational kinetic energy of a golf ball ($KE^t_b$) is directly related to its mass ($m_b$) and linear velocity ($v_b$) such that $KE^t_b=\frac{1}{2} m_b v_b^2$. And, the rotational kinetic energy golf ball ($KE^r_b$) is related to its moment of inertia ($I_b$) and angular velocity ($\omega_b$) such that $KE^r_b=\frac{1}{2} I_b \omega_b^2$.

The potential energy of a golf ball is imbued in the deformation that occurs during impact. When the ball is violently struck by the club face, it is deformed or flattened-out by the force of the impact (~5 KN). Immediately following (~500 μs or so, while the ball is still in contact with the club face), the golf ball seeks to regain its prior spherical shape by rebounding off the club face in a semi-elastic manner. A measure of this rebound is given by the so-called Coefficient of Restitution defined as $e=v_2/v_1=(h_2/h_1)^{1/2}$ where $v_1$ is the incident speed before impact, $v_2$ is the rebound speed after impact, and $h_1$ is the drop height of a ball that subsequently rebounds to $h_2$ after bouncing off a massive horizontal surface (Cross, "The Bounce of a Ball," *American Journal of Physics* 67(3):222-227 (1999), which is hereby incorporated by reference in its entirety). The coefficient of restitution can vary between zero and one corresponding to an inelastic and elastic collision, respectively.

Other physical principles can be employed to analyze the interaction between a golf club and golf ball. For example, Penner, "The Physics of Golf: The Optimum Loft of a Driver," *American Journal of Physics* 69(5):563-568 (2001), which is hereby incorporated by reference in its entirety, utilizes conservation of linear and angular momentum principles to derive mathematical expressions for launch speed, launch angle and spin of a golf ball.

In the various energy and momentum conservation, transference, and/or conversion mechanisms normally involved in the process of striking a golf ball with a golf club, there may be certain additional advantages that can be brought about by incorporating a ferrofluid, a magnetorheological fluid, an inverse magnetorheological fluid, and/or a magnetorheological elastomer in the construction of an adaptive golf ball.

Preferably, but not necessarily, these advantages may come about as a result of using a golf tee and/or a golf club with permanent magnets incorporated therein (i.e., a so-called magnetic golf tee and/or a magnetic golf club).

Preferably, but not necessarily, these advantages would allow the same golf ball to controllably adapt to the shot at hand with regard to increased or decreased distance and/or increased or decreased spin, as the needs of the player change from shot-to-shot.

Core Composition and Spin

With little argument, most would agree that the composition of the core is fundamental to the playing characteristics of a golf ball.

As used herein and throughout, the term "core" shall refer to the innermost portion of a golf ball. The core may or may not include an inner-core and an outer-core.

U.S. Pat. No. 6,299,550 to Molitor et al., which is hereby incorporated by reference in its entirety, points out that "a harder core will produce a higher spin rate than a softer core," Molitor contends that a harder core further compresses the cover of the golf ball against the club face during impact, thereby resulting in more "grab" of the ball by the surface of the club face, with a concomitant increase in spin rate. For a softer core, the cover is under less compressive force against the club face and, therefore, does not contact the club face as intimately during impact, thereby resulting in less spin.

Other core properties affect the characteristics of play. For example, U.S. Pat. No. 7,041,007 to Boehm et al., which is hereby incorporated by reference in its entirety, contends that the central core will preferably be comprised of a low-viscosity fluid for high-spin-rate balls and a high-viscosity fluid for low-spin-rate balls. The viscosity of the core fluid helps to determine (in-part) the spin behavior of a golf ball. For a highly non-viscous liquid core, the moment of inertia (i.e., rotational resistance) is reduced because the liquid center does not immediately respond when the outside of the ball begins to spin. This results in a higher initial rate of spin. Alternatively, for a highly viscous core, one that approaches a semi-solid, the moment of inertia is increased, thereby reducing the amount of spin achieved.

It has long since been known that a liquid core can contribute unique spin properties to a golf ball. Sometimes these properties are beneficial and sometimes they are less so. For example, U.S. Pat. No. 5,885,172 to Hebert et al, which is hereby incorporated by reference in its entirety, contends that "it is desirable that a golfer be able to impart back spin to a golf ball for purposes of controlling its flight and controlling the action of the ball upon landing on the ground." Hebert further contends that "substantial back spin will make the ball stop, once it strikes the landing surface instead of bounding further." On the other hand, too much back spin with a driver for instance, will cause the golf ball to rise too quickly off the tee, thereby compromising overall distance.

However intricate the relationship may be, the composition of the core (including its material properties) determines, in-part, the distance and/or spin characteristics of a golf ball. It would therefore seem reasonable to most that a change in these material properties, through magnetic means, would controllably impact the ball's playability.

Clearly, the properties of the core are not the only determiner of golf ball performance. The core, intervening mantle layer(s) and cover all serve to characterize the performance of a golf ball. To one skilled in the art of golf ball design and manufacture, there would be numerous advantages for magnetically tuning certain material properties of the ball during play.

Magnetic tuning of a golf ball's design parameters (i.e., magnetic tuning of a golf ball's playability) comes about as a result of the inclusion of certain magnetically-smart materials in the construction of a golf ball, thereby rendering it with certain magnetic enhancements.

Adaptive Golf Ball

One aspect of the present invention is directed to a golf ball containing an inner core, one or more mantle layers surrounding the core, and an outer cover surrounding the mantle layer(s). One or more of the core, the mantle layer(s), and/or the cover contains a magnetic fluid and/or magnetic elastomer.

With multiple embodiments, an adaptive golf ball is comprised of one or more mantle layers juxtaposed between an inner core and outer cover, where the core, the mantle layer(s), and/or the cover are further comprised of a ferrofluid, magnetorheological fluid, an inverse magnetorheological fluid and/or a magnetorheological elastomer in any of its construction.

As used herein and throughout, the term "cover" shall refer to the outermost portion of a golf ball. The cover may or may not include an inner-cover and an outer-cover.

As used herein and throughout, the term "mantle" shall refer to any intermediate layer disposed between the inner-core and outer-cover of a golf ball. As such, the outer-core and inner-cover layers may be equivalently referred to as mantle layers.

Referring to FIG. 1, adaptive golf ball 10 according to one embodiment of the present invention rests upon magnetic golf tee 52 just prior to being struck by magnetic golf club (driver) 40. Adaptive golf ball 10 has cover 18, which includes outer cover layer 18B and inner cover layer 18A. Below cover 18 resides a first mantle layer 16A and a second mantle layer 16B. And, below first mantle layer 16A and second mantle layer 16B is spherical reservoir 12 with magnetic fluid 14 contained therein. Magnetic fluid 14 may be a ferrofluid, a magnetorheological fluid, an inverse magnetorheological fluid, and/or combinations thereof.

Adaptive functionality of a golf ball according to the present invention can be achieved in several different ways. Particularly preferred embodiments of the present invention are illustrated in FIGS. 2A-D.

In FIG. 2A, golf ball 10 has inner core 14, which is defined by core reservoir 12. Core 14 is a ferrofluid substance with a viscosity that exhibits a small to mild change in the presence of an externally-applied magnetic field. Mantle layers 16A and 16B enclose core reservoir 12 and core 14. Likewise, mantle layers 16A and 16B are enclosed or surrounded by cover layers 18A and 18B.

While golf ball 10 shown in FIG. 2A has two mantle layers, the golf ball of the present invention may have as few as one mantle layer or up to 2, 3, 4, or more mantle layers as necessary. Preferably, but not necessarily, mantle layers 16A and/or 16B are fashioned from natural rubber, polybutadiene, and/or HPF (E.I. DuPont de Nemours & Company, Wilmington, Del.).

In the embodiment illustrated in FIG. 2A, cover 18A is an inner cover and cover 18B is an outer cover. However, the golf ball of the present invention may have a single cover layer or more than one cover layer (e.g., two layers constituting an inner cover layer and an outer cover layer). In any event, the term "cover" refers to the outermost portion of the golf ball of the present invention. As mentioned supra, the cover of the golf ball is typically constructed of a thermoset castable urethane material with "dimples" formed thereupon that facilitate certain aerodynamic advantages during flight. Other suitable materials for the exterior cover of a golf ball are also known and may be used. For example, the cover may be constructed of an ionomer material with a high flexural modulus, thereby facilitating good energy transfer between the golf ball and a golf club.

In another embodiment illustrated in FIG. 2B, golf ball 10 has core 14, which is defined by core reservoir 12. Core 14 is a magnetorheological fluid and/or an inverse magnetorheological fluid whose viscosity exhibits a dramatic change in the presence of an externally-applied magnetic field, thereby changing the playability of the ball. In the presence of a magnetic field, as supplied for instance by a magnetic golf tee and/or magnetic golf club (i.e., a golf tee or golf club with permanent magnets, as described infra), core 14 will exhibit a semi-solid-like character with less spin resulting. Conversely, in the absence of a magnetic field (i.e., on the fairway or a green, for example, with a conventional, non-magnetic golf club) core 14 will exhibit a semi-liquid-like character with more spin resulting. In this way, golf ball 10 will exhibit markedly-different playing characteristics depending on the presence or absence of a magnetic field.

Like the golf ball illustrated in FIG. 2A, golf ball 10 of FIG. 2B has mantle layers 16A and 16B and cover layers 18A and 18B.

Preferably, but not necessarily, in the case of magnetic fluids (ferrofluids, magnetorheological fluids, and/or inverse magnetorheological fluids), magnetic control over the ball's playability is imbued in the so-called "magneto-viscous" effect, wherein a magnetic field causes a change in the viscosity of the core medium.

In yet another embodiment of the present invention illustrated in FIG. 2C, mantle layer 16B of golf ball 10 is made of a magnetorheological elastomer whose material properties (elasticity, hardness, flexural modulus, compression, etc.) exhibit a change in the presence of an externally-applied magnetic field, thereby changing the playability of golf ball 10. Preferably, but not necessarily, in the case of a magnetorheological elastomer, magnetic control over the ball's playability is imbued in the so-called "magneto-elastic" effect, wherein a magnetic field causes a change in the elasticity of the medium.

In still yet another embodiment illustrated in FIG. 2D, core 14 of golf ball 10 has permanent magnet 20, immersed within a spherical liquid reservoir of ferrofluid or inverse-magnetorheological fluid 22. Permanent magnet 20 is spherical in shape, magnetically-levitated, and self-centered within liquid reservoir 22 in a freely-rotating manner. When external magnet 24 is brought close enough to golf ball 10, permanent magnet 20 swivels or re-orients itself so as to always be in magnetic attraction with external magnet 24, regardless of the orientation of external magnet 24. And, said swiveling motion occurs internally to the ball (i.e. without any external movement of the ball).

Preferably, but not necessarily, permanent magnet 20 is fashioned from rare-earth iron materials. More preferably, but not necessarily, permanent magnet 20 is fashioned from Neodymium-Iron-Boron or Samarium-Cobalt magnets.

The embodiment of golf ball 10 illustrated in FIG. 2D is particularly significant because (i) the magnetic force of attraction can be considerably strengthened between golf ball 10 and a magnetic golf tee and/or magnetic golf club with permanent magnet 24 integrated therein; (ii) golf ball 10 will always be in magnetic attraction to a magnetic golf tee and/or magnetic golf club with permanent magnet 24 integrated therein, regardless of its lie; and (iii) permanent magnet 20 floating within ferrofluid reservoir 22 is not in direct contact with mantle layer 16 and cover 18, thereby facilitating extraordinary spin properties of golf ball 10, with or without an external magnet present. When a golf ball according to this particular embodiment of the present invention is struck by any golf club (magnetic or non-magnetic), the cover and mantle layer(s) will spin independently from the core thus allowing them to rotate at a higher rate of spin. And, as pointed out in U.S. Pat. No. 6,325,730 to Binette, "a golf ball with the capacity to obtain a high rate of spin allows a skilled golfer the opportunity to maximize control over the ball. This is particularly beneficial when hitting a shot on an approach to the green." Other design advantages exist for a floating magnetic core golf ball. For example, the surface of the magnet can be smooth or structured with laminar or turbulent flow conditions resulting when the ball is struck. Or, one may add various micron-sized particles to the ferrofluid or inverse-magnetorheological fluid, thereby tuning the spin aptitude of the ball.

For anyone who is skilled in the art of golf ball design, an adaptive golf ball could, in principle, make use of multiple magnetic enhancing means. For example, one could combine a magnetorheological elastomer mantle layer with a magnetorheological fluid core. Such a combination may help to concentrate the magnetic field lines presented to the core, thereby accentuating the magneto-viscous effect.

Whatever the specific embodiment may be, golf balls conforming to the present invention encompass any type of ball construction that utilizes a ferrofluid, a magnetorheological fluid, an inverse magnetorheological fluid and/or a magnetorheological elastomer in any of its construction, to (a) facilitate its play and/or (b) facilitate its manufacture.

Still another aspect of the present invention is directed to a method of manufacturing a golf ball. This method involves providing an inner core, one or more mantle layer(s), and an outer cover, where one or more of the core, the mantle layer, and/or the cover contain(s) a magnetic fluid and/or magnetic elastomer. The mantle layer is applied to the core under conditions effective to surround the core with the mantle layer. The mantle layer is applied to the cover under conditions effective to surround the mantle layer with the outer cover, thereby manufacturing a golf ball.

In carrying out the manufacturing method of the present invention, it may be desirable to effect a magnetic interaction between an external magnet and the magnetic fluid and/or magnetic elastomer contained in the golf ball. In one embodiment, the external magnet is a permanent magnet. Alternatively, the external magnet is an electro-magnet. The permanent magnet and/or electro-magnet may be incorporated into machinery used to manufacture, handle, sort, store, package, and/or label, pick, or store, the golf ball.

The adaptive golf ball of the present invention may also be amenable to improved methods of raking golf balls (e.g., in gathering golf balls from a driving range) and/or retrieving golf balls from water, a golf cup, or from the ground. A golf ball of the present invention that incorporates a permanent magnet in its core, mantle layer(s), and/or cover would be particularly amenable to these methods.

Most notable of the adaptive golf bail according to the present invention is its ability to comply with the size, weight, initial velocity overall distance and spherical symmetry requirements of the USGA's Rules of Golf.

Preferably, but not necessarily, the source of the externally-applied magnetic field is due to one or more permanent magnets integrated into a magnetic golf tee and/or a magnetic golf club whose descriptions now follow.

Magnetic Golf Tee

The method of playing golf of the present invention may further involve effecting a magnetic interaction between an adaptive golf ball of the present invention and a permanent magnet contained in a golf tee.

A magnetic golf tee contains a housing with one or more permanent magnets integrated therein, for purposes of evoking a change in playability of an adaptive golf ball of the present invention during tee off.

In reference to FIG. 1, adaptive golf ball 10 according to the present invention is resting upon magnetic golf tee 52 that is further comprised of housing 56 with permanent magnet 54 contained therein, and head (i.e., engagement surface) 58 contained thereon. Magnetic golf tee 52 rests upon ground 50.

Preferably, but not necessarily, permanent magnet 54 is fashioned from rare-earth iron materials. More preferably, but not necessarily, permanent magnet 54 is fashioned from Neodymium-Iron-Boron or Samarium-Cobalt magnets.

When an adaptive golf ball with a magnetorheological fluid core is resting upon a magnetic golf tee (i.e., in the presence of a magnetic field), the core will exhibit a highly-viscous, semi-solid-like character with the advantages of reduced spin and greater distance off the tee. On the fairway and green however, without the use of a magnetic golf tee (i.e., in the absence of a magnetic field), the same magnetorheological fluid core will exhibit a highly-non-viscous, semi-liquid-like character with greater spin, better feel, and enhanced control. In this way, the same adaptive golf ball will exhibit substantially different playing characteristics depending on the use, or not, of a magnetic golf tee.

In one preferred embodiment that pays homage to the original "pile-of-sand" golf tees of old, FIG. 3A illustrates magnetic golf tee 52 comprised of conical permanent magnet 54, surrounded by conical housing 56, with brush-like head 58 to support adaptive golf ball 10. In this particular design, conically-shaped permanent magnet 54 is thought to help concentrate the density of magnetic field lines in close proximity to adaptive golf ball 10, thereby accentuating the magnetic interaction between the ball and tee.

Preferably, but not necessarily, conical housing 56 of magnetic golf tee 52 is fashioned from Delrin, or some other thermoplastic material that will not scratch or mar the club face should incidental contact be made while the adaptive golf ball is being struck.

Preferably, but not necessarily, head 58 of magnetic golf tee 52 is replaceable and disposable, should incidental contact be made by a swiftly-encroaching golf club with damage resulting.

Preferably, but not necessarily, head 58 of magnetic golf tee 52 is fashioned from wood, clay, cellulose, and/or any other inexpensive, easily-replaced, natural material.

A magnetic golf tee used in conjunction with an adaptive golf ball of the present invention is easier to use than a conventional (i.e., non-magnetic) golf tee, because the ball is magnetically held in place. For an adaptive golf ball, there is no balancing required on top of a magnetic golf tee as compared to a traditional golf tee.

In FIG. 3B, the magnetic golf tee takes on a more traditional shape with sharply-tipped body 88 for insertion into the soft ground. The player rests adaptive golf ball 10 onto head 90 of tee 92. In this specific embodiment, spherical permanent magnet 20 with magnetic poles "N" and "S", is magnetically-levitated within spherical ferrofluid reservoir 22. Permanent magnet 20 and ferrofluid reservoir 22 together comprise core 14 of adaptive golf ball 10. Magnetic attraction (repulsion) between opposite (like) poles causes permanent magnet 20 to swivel or rotate into magnetic alignment with permanent magnet 86 integrated within magnetic golf tee 92. In this way, adaptive golf ball 10 is always in magnetic attraction to magnetic golf tee 92.

Preferably, but not necessarily, head 90 of magnetic golf tee 92 is fashioned in the shape of a concave spherical cup, whose radius of curvature is more or less equivalent to that of adaptive golf ball 10.

While "teeing off" (i.e., striking a golf ball that is resting upon a golf tee) one may wish to employ either a traditional (i.e., non-magnetic) golf tee, or a magnetic golf tee, depending on the desired shot at hand.

Use of a non-magnetic golf tee on an adaptive golf ball may result in ordinary playability of the ball. Use of a magnetic golf tee on an adaptive golf ball may result in extraordinary playability of the same ball, thereby allowing the advanced player a more sophisticated selection of shot solution.

Whatever the specific embodiment may be, golf tees conforming to the present invention encompass any type of geometry (i.e., flat head, concave spherical-cup head, concave conical-cup head, brush-head, etc.) that are used in conjunction with one or more permanent magnets to support and/or interact with, an adaptive golf ball of the present invention.

Magnetic Golf Club

Another aspect of the present invention relates to a method of playing golf. This method involves providing an adaptive golf ball of the present invention and striking the golf ball with a golf club.

In carrying out this method of the present invention, either a traditional (i.e., non-magnetic) golf club or a magnetic golf club can be used, depending on the desired shot at hand. With a magnetic golf club, one or more permanent magnets are preferably positioned immediately-behind and centered-upon the golf club face (i.e., the hitting surface of the club head). In this manner, a golf club can be used to effect a magnetic interaction between the golf ball of the present invention and a permanent magnet.

A magnetic golf club is comprised of a shaft (including a grip) attached to a club head, where one or more permanent magnets are integrated immediately-behind and centered-upon the club face (i.e., the hitting surface of the club head) for purposes of evoking a change in playability of an adaptive golf ball of the present invention.

Most average golf players routinely suffer from mediocre-to-poor placement of the golf ball's point of impact on the surface of the club face (i.e., mis-hits). De-skilling of athleticism with shorter skis, larger tennis rackets and larger golf club heads is a wide-spread, societal trend, thereby allowing the mediocre athlete (the largest market share of sporting enthusiasts) to enjoy an elevated level of play. This explains (in part) the growing trend of increasing club size (i.e., increasing the hitting surface to allow a statistical reduction of mis-hits).

In further reference to FIG. 1, magnetic golf club 40 with club head 44 incorporates one or more permanent magnets 48 situated immediately-behind and centered-upon club face 46. Whilst swinging golf club shaft 42 (and, by extension, magnetic golf club head 44), immediately before impact of club face 46 with adaptive golf ball 10, ball 10 will be instantaneously attracted to permanent magnet 48, thereby establishing a statistical preponderance for being struck with the optimal hitting zone of club face 46. This may result in a statistical reduction of miss-hits for the average player.

In those instances when a golf tee (magnetic or otherwise) is not allowed during play (e.g., on the fairway and green), one may wish to employ either a traditional (i.e., non-magnetic) golf club or a magnetic golf club, depending on the desired shot at hand.

Use of a non-magnetic golf club on an adaptive golf ball may result in ordinary playability of the ball.

Use of a magnetic golf club on a traditional (i.e., non-adaptive) golf ball will necessarily result in ordinary playability of the ball.

Use of a magnetic golf club on an adaptive golf ball may result in extraordinary playability of the ball, thereby allowing the advanced player a more sophisticated selection of shot solution.

In one preferred embodiment, a magnetic golf club is used to strike an adaptive golf ball, where the magnetorheological fluid core of the ball exhibits a semi-solid-like character due to the magneto-viscous effect, thereby resulting in extraordinary playability of the ball. Alternatively, a non-magnetic golf club may be used to strike the same adaptive golf ball, where the magnetorheological fluid core exhibits a semi-liquid-like character, thereby resulting in ordinary playability of the ball. In this way, the player can control the playability of an adaptive golf ball through a judicious choice of magnetic and/or non-magnetic golf clubs.

In another preferred embodiment, a magnetic golf club is used to strike an adaptive golf ball, where a permanent spherical magnet is levitated within a spherical ferrofluid core. As the magnetic golf club approaches the ball, the spherical magnet at the core of the ball swivels into magnetic alignment with the swiftly approaching permanent magnet integrated into the club head, thereby allowing the ball to be instantaneously attracted to the optimal hitting zone of the club face, resulting in extraordinary playability of the ball.

In FIG. 4A, "wood" style golf club 40 has shaft 42 and club head 44. Permanent magnet 48 is positioned in club head 44 proximate club face 46. In FIG. 4B, "iron" style golf club 60 has shaft 62 and club head 68. Permanent magnet 66 is positioned in club head 68 proximate club face 64. Whilst swinging either golf club shaft 42 of golf club 40 (FIG. 4A) or golf club shaft 62 of golf club 60 (FIG. 4B) (and, by extension, golf club head 44 and 68, respectively), immediately before impact of either club face 46 or 64 with an adaptive golf ball of the present invention, the golf ball will be instantaneously attracted to permanent magnets 48 or 66, thereby establishing a statistical preponderance for being struck with the optimal hitting zone of either club face 46 or 64. This may result in a statistical reduction of miss-hits for the average player.

There may be several novel advantages with regard to the various energy and momentum conservation, transference, and/or conversion mechanisms involved in the process of striking an adaptive golf ball with a magnetic golf club. For instance, the brief magnetic attraction that occurs immediately before impact could allow for an increase in the initial velocity of the ball with greater distances resulting. Or, this same magnetic attraction could allow for a more intimate contact between the club face and ball during impact, thereby increasing the amount of spin. Or, this same magnetic attraction could move the statistical point of impact on the club face closer to the center of the optimal hitting zone.

The interaction between a magnetic golf club and an adaptive golf ball of the present invention depends upon the magnetic field produced by one or more permanent magnets integrated into the club and/or the ball. Consequently, the magnitude of the interaction can be precisely controlled by the number, shape, material, size, and strength of the permanent magnets integrated therein.

Preferably, but not necessarily, the permanent magnets integrated into the club head are fashioned from rare-earth iron materials.

More preferably, but not necessarily, the permanent magnets integrated into the club head are fashioned from Neodymium-Iron-Boron or Samarium Cobalt magnets.

Preferably, but not necessarily, the permanent magnets integrated into the club head are fashioned into a cylindrical, oval or conical shape.

Whatever the specific embodiment may be, golf clubs conforming to the present invention encompass any type of geometry (i.e., woods, irons, putters, etc.) that employ one or more permanent magnets integrated into the club head for purposes of exerting extraordinary control over the playability of an adaptive golf ball of the presented invention.

Magnetic Fluids and Magnetic Elastomers

Contrary to some authors (e.g., Fertman, "*Magnetic Fluids Guidebook. Properties and Applications*," Luikov Institute, Minsk, Hemisphere Publishing Corporation, 1990, ISBN: 891169563, which is hereby incorporated by reference in its entirety), the term "magnetic fluid" as used herein and throughout, shall mean any system of magnetic and/or magnetizable particles immersed in a carrier liquid that is responsive to a magnetic field. Magnetic fluids are characterized by their volume, particle size (including the distribution of sizes), particle shape (including the distribution of shapes), particle composition (including magnetic permeability and hardness of same), fraction of particles (by weight or volume), carrier liquid, and any number of other sparse additives such as, surfactants, dispersants (i.e., anti-agglomeration and/or anti-settling agents), stabilizers, lubricants, anti-oxidants, pigments, etc., that further serve to functionalize the magnetic fluid for a specific application.

Magnetic fluids are typically categorized according to the size of the magnetic and/or magnetizable particles contained therein.

Magnetic fluids with particles in the diameter range from about 2 nm to about 10 nm are called "ferrofluids."

As used herein and throughout, the term "ferrofluid" shall mean a, colloidal suspension of surfactant-coated, nanometer-sized, single-domain, magnetic particles immersed in a carrier liquid that exhibits little to no change in viscosity as a function of an externally-applied magnetic field.

Preferably, but not necessarily, the magnetic particles contained in a ferrofluid are magnetite ($Fe_3O_4$), maghemite ($Fe_2O_3$), cobalt ferrite ($CoFe_2O_4$), manganese ferrite ($MnFe_2O_4$) and/or any other ferro-magnetic or ferri-magnetic nanoparticle.

Preferably, but not necessarily, the magnetic particles in a ferrofluid are spherical in shape.

Preferably, but not necessarily, the carrier liquid in a ferrofluid includes, without limitation, animal oil, vegetable oil, petroleum oil, petroleum distillates, glycol, glucose, mineral oil, corn oil, silicone oil, synthetic oil, vegetable oil, water, alcohol, diethylene glycol, glycerol, dibutyl phthalate, tetradecane ($C_{14}H_{30}$), and/or any other viscous liquid that is chemically inert relative to the magnetic particles suspended therein.

Preferably, but not necessarily, the surfactant utilized in a ferrofluid is oleic acid, citric acid, soy lecithin, tetramethylammonium hydroxide, perfluoropolyether acid, polyisobutene succinic acid, ricinoleic acid, and/or polyisobutene.

Ferrofluids of various types are commercially available from FerroTec (Nashua, N.H. (USA)), FerroLabs (Dulles, Va. (USA)), and Liquids Research Limited (Bangor, North Wales).

A second class of magnetic fluids contains magnetizable particles in the diameter range from about 0.1 μm to about 10 μm, or larger. These so-called magnetorheological ("MR") fluids are important because they exhibit a very large (~several orders of magnitude) and very fast (~millisecond) variation in viscosity as a function of some externally-applied magnetic field.

As used herein and throughout, the term "magnetorheological fluid" shall mean a non-colloidal suspension of micrometer-sized, multi-domain, magnetizable particles immersed in a carrier liquid that exhibits a large change in viscosity as a function of some externally-applied magnetic field.

Referring to FIG. 5A, in the absence of a magnetic field, the magnetizable particles contained in a magnetorheological fluid are randomly distributed within the liquid carrier medium. However, when a magnetic field is applied to the MR fluid in FIG. 5B, these same magnetizable particles form chain-like structures along the magnetic field that tend to impede macroscopic flow of the fluid.

Magnetorheological fluids in the "on" state (i.e., in the presence of a magnetic field) behave theoretically like a "Bingham" plastic with semi-solid-like characteristics. In the "off" state (i.e., in the absence of a magnetic field) magnetorheological fluids behave theoretically like a "Newtonian" fluid with semi-liquid-like characteristics. Interestingly, the volume of a magnetorheological fluid remains constant in each of these two decidedly-different states.

The viscosity of a magnetorheological fluid in the "off" state depends on the viscosity of the carrier liquid, the volume fraction of magnetizable particles present, the size and shape of the particles, the amount and type of additives present, and the shear rate at which the viscosity is being measured. In addition to these, the viscosity of an MR fluid in the "on" state also depends on the magnitude of the magnetic field present.

Preferably, but not necessarily, the magnetizable particles in a magnetorheological fluid are comprised of carbonyl iron (BASF, Ludwigshafen, Germany).

Preferably, but not necessarily, the magnetizable particles of a magnetorheological fluid are spherical in shape.

Preferably, but not necessarily, the carrier liquid in a magnetorheological fluid includes, without limitation, mineral oil, corn oil, silicone oil, synthetic oil, vegetable oil, water, alcohol, diethylene glycol, glycerol, dibutyl phthalate, tetradecane ($C_{14}H_{30}$), and/or any other viscous liquid that is chemically inert relative to the magnetizable particles suspended therein.

Liquid carrier mediums may also contain anti-oxidizing, anti-corrosion, anti-wear, anti-agglomeration, and/or anti-settling agents.

Magnetorheological fluids of various types are commercially available from LORD Corporation (Cary, N.C. (USA)), FerroLabs (Dulles, Va. (USA)), and Liquids Research Limited (Bangor, North Wales).

A third class of magnetic fluids result when micrometer-sized, non-magnetic particles are suspended in a ferrofluid liquid medium. These so-called inverse magnetorheological fluids, or magnetorheological composite fluids, have significant potential for use in an adaptive golf ball due in-part to the extensive choice of materials to be used for the non-magnetic particles. Either metallic or non-metallic (i.e., dielectric) particles are available for use, providing a rich assortment of properties to be exploited for addressing numerous playability and/or manufacturability concerns.

As used herein and throughout, the term "inverse magnetorheological fluid" shall mean a non-colloidal suspension of micrometer-sized, non-magnetic particles immersed in a ferrofluid liquid medium that exhibits a change in one or more of its material properties as a function of some applied magnetic field.

Another important class of magnetic fluids that could prove useful in the construction of an adaptive golf ball is magnetic pigments. Magnetic pigments are typically comprised of a distribution of magnetizable particles and/or flakes immersed in an ink, dye, stain, paint, and/or any other kind of pigmentation agent. Magnetic pigments are commercially available from BASF (Ludwigshafen, Germany).

Data can be read (written) from (to) a magnetic pigment coating layer by means of a magnetic recording head. As such, use of a magnetic pigment would facilitate various labeling schemes for unequivocal identification of an adaptive golf ball of the present invention. Magnetic labeling schemes would also prove useful throughout the manufacturing process of conventional golf balls.

Preferably, but not necessarily, magnetic pigments include acicular iron oxide and chromium oxide pigments.

Magnetic elastomers are another important class of materials to be considered in the construction of an adaptive golf ball.

As used herein and throughout, the term "magnetic elastomer" shall mean a distribution of magnetic and/or magnetizable particles suspended in a polymer medium that exhibits a change in one or more of its material properties (elasticity, hardness, flexural modulus, compression, etc,) as a function of some applied magnetic field.

Preferably, but not necessarily, the polymer medium includes, without limitation, natural rubber, synthetic rubber, polybutadiene, polyisoprene, urethane, polyurethane, polyvinyl alcohol, silicone elastomer, ionomeric resins, HPF (a copolymer of ethylene and acrylic acid developed by DuPont), balata, gutta purcha, and/or any other polymer medium that is chemically inert relative to the magnetic and/or magnetizable particles suspended therein.

Preferably, but not necessarily, the magnetic and/or magnetizable particles in a magnetic elastomer are uniformly distributed within the polymer medium.

A particularly useful aspect of a cured magnetic polymer is the unique three-dimensional distribution of fixed magnetic and/or magnetizable particles contained therein. Such a distribution could be viewed as a machine-readable, impossible-to-duplicate, magnetic "signature" or "fingerprint" for unequivocal identification purposes.

Nanotechnology plays an important role in all magnetic fluids and magnetic elastomers because of the physical, chemical and magnetic interactions that occur on the nanometer-scale.

Magnetic Materials and Permanent Magnets

Fundamental to the understanding of an adaptive golf ball of the present invention is the behavior of magnetic materials and permanent magnets.

The magnetic properties of a material are imbued in the constitutive relations $\vec{B}=\mu\vec{H}$ and $\vec{M}=\chi_m\vec{H}$, where $\vec{B}$ is the magnetic induction or magnetic flux density (in Tesla), $\vec{H}$ is the applied magnetic field (in Amps/meter), $\vec{M}$ is the magnetization (in Amps/meter), $\mu$ is the permeability (in Henrys/meter), and $\chi_m$ is the magnetic susceptibility (unitless), When a magnetic field $\vec{H}$ is applied to a magnetic material, the material responds by producing a magnetization $\vec{M}$, whereby $\vec{B}=\mu_0(\vec{H}+\vec{M})$ such that $\mu=\mu_0(1+\chi_m)$ with $\mu_0 4\pi\times10^{-7}$ kg-m/C$^2$ (the permeability of free space).

Materials with a magnetic susceptibility $\chi_m>0$ are called paramagnetic in that their presence causes a strengthening of the magnetic induction relative to the applied magnetic field.

In paramagnetic materials, each atom has a magnetic moment that is randomly oriented as a result of thermal motion. Examples of paramagnetic materials include Aluminum: Al ($\chi_m=+16.5\times10^{-6}$) and Titanium: Ti ($\chi_m=+151\times10^{-6}$).

Materials with a magnetic susceptibility $\chi_m<0$ are called diamagnetic in that their presence causes a weakening of the magnetic induction relative to the applied magnetic field. In diamagnetic materials, each atom has zero magnetic moment. Examples of diamagnetic materials include Gold: Au ($\chi_m=-28\times10^{-6}$), Copper: Cu ($\chi_m=-5.46\times10^{-6}$), and Bismuth: Bi ($\chi_m=-280.1\times10^{-6}$).

For most paramagnetic and diamagnetic materials, the magnetic susceptibility is very small $|\chi_m|<<1$. Equivalently, the relative permeability defined as $\mu_1=\mu/\mu_0=(1+\chi_m)$ is very nearly equal to unity (i.e., $\mu\approx\mu_0$) for most paramagnetic and diamagnetic materials.

As used herein and throughout, the term "non-magnetic particles" shall refer to those particles that are comprised of paramagnetic or diamagnetic materials.

Ferromagnetic materials exhibit non-linear, hysteretic behavior between the magnetic induction and the applied magnetic field, such that $\vec{B}=\mu(\vec{H})\vec{H}$, where $\mu=\mu(\vec{H})$ is field dependent. Ferromagnetic materials have their atoms arranged in a lattice with their magnetic moments aligned parallel to each other. In the periodic table of elements, only Iron (Fe), Cobalt (Co), and Nickel (Ni) are ferromagnetic at room temperature.

As used herein and throughout, the term "magnetic particles" or "magnetizable particles" shall refer to those particles that are comprised of ferromagnetic elements and/or ferrimagnetic compounds.

Ferromagnetic materials constitute those materials that are most often used to fabricate permanent magnets.

The magnetic induction $\vec{B}$ changes as a function of an applied magnetic field $\vec{H}$ in a never-before-magnetized sample of ferromagnetic material (i.e., the so-called induction curve or "hysteresis" loop).

Referring to FIG. 6, as $\vec{H}$ is first increased from zero (point 1, along the dashed line), there are only small increases in $\vec{B}$, during which time there is a stretching of magnetic domain boundaries in the material. As $\vec{H}$ is further increased, $\vec{B}$ begins to increase more and more rapidly until small increases in $\vec{H}$ bring about large increases in $\vec{B}$. In this region, magnetic domains grow in the direction of $\vec{H}$. As $\vec{H}$ is further increased, increases in $\vec{B}$ begin to slow down. Increasing $\vec{H}$ beyond a saturating value $H_s$ causes no further increases in $\vec{B}$ beyond its saturation value $B_s$ (FIG. 6, point 2). After reaching saturation, if the magnetic field $\vec{H}$ is reduced in magnitude back down to zero, the magnetic induction $\vec{B}$ does not follow along the initial B-H curve. Instead, it follows a new curve with a Residual Induction $B_r$ occurring at $\vec{H}=0$ (FIG. 6, point 3). The residual induction $B_r$ is often used to differentiate between so-called "hard" magnetic materials and "soft" magnetic materials. Hard magnetic materials typically have a large residual induction as compared to soft magnetic materials.

If the direction of the applied magnetic field $\vec{H}$ is reversed (i.e., the magnetic field is allowed to take on negative values), the magnetic induction $\vec{B}$ will continue to decrease until it reaches a value of zero at $H=-H_c$ (FIG. 6, point 4), where $H_c$ is called the Normal Coercive Force. Increasing the applied magnetic field further (in the reverse direction) will cause the magnetic induction to take on negative values. Eventually, the magnetic induction will saturate again (FIG. 6, point 5), at which time further negative increases in $\vec{H}$ will bring about no further changes in $\vec{B}$. As $\vec{H}$ is again reduced in magnitude towards zero, the magnetic induction will reach its residual value $-B_r$ (FIG. 6, point 6). And finally, as the magnetic field $\vec{H}$ increases from zero in the forward direction, the magnetic induction $\vec{B}$ will pass through zero at $H=+H_c$ (FIG. 6, point 7) and continue on to $B=B_s$ at $H=H_s$ (FIG. 6, point 2), thereby closing the hysteresis loop.

In the traditional design of permanent magnets the complete hysteresis loop is seldom used. More often than not, only quadrant II (FIG. 6) of the complete induction curve is given, along with $H_s$. Quadrant II of the hysteresis loop is typically called the "demagnetization curve" (Moskowitz, *Permanent Magnet Design and Application Handbook*, Krieger Publishing Company, 1987, ISBN: 0-89874-863-1, which is hereby incorporated by reference in its entirety).

Hard magnetic materials have a high resistance to demagnetization. As a result, hard magnetic materials are the basis for all permanent magnets.

The properties of a permanent magnet typically include: Residual Induction $B_r$, Normal Coercive Force $H_c$, and maximum Energy Product $BH_{max}$. $BH_{max}$ is simply the largest product of $\vec{B}$ and $\vec{H}$ along the demagnetization curve. This corresponds to that point on the curve which yields the largest area for an enclosed rectangle in Quadrant II of the hysteresis loop. The maximum Energy Product $BH_{max}$ is a measure of the ability of a permanent magnet to do work per unit volume of material.

Preferably, but not necessarily, materials to be used in the fabrication of permanent magnets to be included in an adaptive golf ball of the present invention, a magnetic golf club of the present invention, and/or a magnetic golf tee of the present invention include Fe, Co, Ni, $BaO:Fe_2O_3$, $SrO:Fe_2O_3$, $MnO:Fe_2O_3$, and/or combinations thereof.

More preferably, but not necessarily, materials to be used in the fabrication of permanent magnets to be included in an adaptive golf ball, a magnetic golf club, and/or a magnetic golf tee of the present invention include, without limitation. Alnico. NdFeB, SmCo, FeCrCo, $BaO:Fe_2O_3$, $SrO:Fe_2O_3$, $MnO:Fe_2O_3$, Pb: $Fe_2O_3$, $Nd_2Fe_{14}B$, $Sm_2Fe_{17}N_3$, $Sm_2Co_{17}$, $SmCo_5$, $BaFe_{12}O_{19}$, and/or combinations thereof (Coey, "Permanent Magnetism," *Solid State Communications* 102 (2):101-105 (1997), which is hereby incorporated by reference in its entirety).

Preferably, but not necessarily, methods of producing permanent magnets will include those disclosed in U.S. Pat. No. 4,496,395 to Croat, U.S. Pat. No. 4,597,938 to Matsuura, U.S. Pat. No. 4,837,109 to Tokunaga, and/or U.S. Pat. No. 6,302,939 to Rabin, all of which are hereby incorporated by reference in their entirety.

Permanent magnets of various types are commercially available from Master Magnetics (Castle Rock, Colo. (USA)), AMF Magnetics (Mascot, NSW (Australia)), and Eclipse Magnetics (Sheffield, England).

Magnetic Levitation

Magnetic levitation is a phenomenon by which an object is suspended against the force of gravity with no other means of support, other than a magnetic field.

Earnshaw's theorem states that it is not possible to levitate a magnet in a stable manner using any possible arrangement of other magnets. However, there are ways of circumventing this theorem.

Rosensweig, "Buoyancy and Stable Levitation of a Magnetic Body Immersed in a Magnetizable Fluid," *Nature* 210 (5036):613-614 (1966), which is hereby incorporated by reference in its entirety, points out that a permanent magnet can be levitated within a volume of ferrofluid. This phenomenon can be used to de-couple the spin properties of the cover from the spin properties of the core in an adaptive golf ball of the present invention with extraordinary spin properties resulting.

Simon, "Diamagnetically Stabilized Magnet Levitation," *American Journal of Physics* 69(6): 702-713 (2001), which is hereby incorporated by reference in its entirety, has pointed out that diamagnetic materials can be used to help levitate a permanent magnet in a stable manner. Such an approach could be utilized in the production of an adaptive golf ball of the present invention to center the magnetic core within the overlying mantle and/or cover layer(s), thereby precluding the use of retractable retaining pins in the molding process.

Simon, "Spin-Stabilized Magnetic Levitation," *American Journal of Physics* 65(4):286-292 (1997), which is hereby incorporated by reference in its entirety, has additionally pointed out that a magnet can be stably levitated by spinning it within a magnetic field produced by an arrangement of other permanent magnets. A spinning adaptive golf ball with a magnetic core might be compatible with such means of levitation. It can also be argued that this same phenomenon (i.e. a spinning magnet immersed in a magnetic field) will result in extraordinary flight of a spinning (i.e., after club impact), adaptive golf ball with a magnetic core relative to the Earth's magnetic field.

Williams, "Electromagnetic Levitator," *Electronics Now* 67(2):67-70 (1996) and Cicon, "Building a Magnetic Ball Levitator," *Popular Electronics* 13(5):48-52 (1996), which are hereby incorporated by reference in their entirety, have both pointed out that a magnetic object can be dynamically levitated against the force of gravity through servo-stabilization, where the position and/or trajectory of an object is sensed and an electro-magnet is used to compensate for the motion of the object with servo feedback. A similar principle could be used to levitate an adaptive golf ball above an electro-magnetic golf tee, thereby allowing non-contact support of the ball during tee-off.

The invention described herein is not meant to be limited in scope by the specific examples disclosed. These examples are intended to be illustrative of the invention only and not wholly encompassing of it.

EXAMPLES

The examples below are intended to exemplify the practice of the present invention but are by no means intended to limit the scope thereof.

Prophetic Example 1

Ferrofluid Core Golf Ball

An adaptive golf ball according to the present invention has a hollow, spherical, thermoplastic shell filled with DHYS1-a ferrofluid from Liquids Research Limited. Surrounding the thermoplastic shell is a first polybutadiene mantle layer and a second Surlyn mantle layer followed by a thermoset urethane outer cover layer with a polyhedron pattern of dimples formed thereupon.

Prophetic Example 2

Magnetorheological Fluid Core Golf Ball

An adaptive golf ball according to the present invention has a hollow, spherical, thermoplastic shell filled with MRF-140CG-250 magnetorheological fluid from LORD Corporation. Surrounding the thermoplastic shell is a first polybutadiene mantle layer and a second Surlyn mantle layer followed by a thermoset urethane outer cover layer with a polyhedron pattern of dimples formed thereupon.

Prophetic Example 3

Magnetorheological Elastomer Core Golf Ball

An adaptive golf ball according to the present invention has a solid, spherical, iron-impregnated polybutadiene, (i.e., magneto-elastic) core. Surrounding the core is a Surlyn mantle layer followed by a thermoset urethane outer cover layer with a polyhedron pattern of dimples formed thereupon.

Prophetic Example 4

Magnetic Core Golf Bail

An adaptive golf ball according to the present invention has a hollow, spherical, thermoplastic shell filled with EFH1 ferrofluid from FerroTee. Self-centered and magnetically-levitated within said ferrofluid is a spherical, Neodymium-Iron-Boron permanent magnet. Surrounding the thermoplastic shell is a first HPF resin mantle layer and a second Surlyn mantle layer followed by a thermoset urethane outer cover layer with a polyhedron pattern of dimples formed thereupon.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A method of utilizing a golf ball comprising:

a) providing a golf ball comprising a magnetic fluid;

b) providing a golf club;

c) moving a portion of the golf club into contact with the golf ball; and d) effecting a magnetic interaction between the golf ball and a magnet external to the golf ball, wherein the golf ball comprises:

an inner core; and one or more mantle layers surrounding the inner core; and an outer cover surrounding the mantle layer(s), wherein the inner core is further comprised of a permanent magnet immersed in a ferrofluid, and the ferrofluid is further comprised of a colloidal suspension of nanometer-sized, single-domain, magnetic particles immersed in a carrier liquid.

2. The method according to claim 1, wherein the magnetic particles comprise ferromagnetic, anti-ferromagnetic, or ferrimagnetic substances.

3. The method according to claim 2, wherein the ferromagnetic, anti-ferromagnetic, or ferrimagnetic substances comprise iron, cobalt, nickel, magnetite, maghemite, cobalt ferrite, manganese ferrite, carbonyl iron, or combinations thereof.

4. The method according to claim 1, wherein the carrier liquid comprises water, animal oil, mineral oil, vegetable oil, synthetic oil, petroleum oil, petroleum distillates, alcohol, glycol, glucose, or combinations thereof.

5. The method according to claim 1, wherein the carrier liquid further comprises anti-oxidizing, anti-corrosion, anti-wear, anti-agglomeration, anti-settling agents, or combinations thereof.

6. The method according to claim 1, wherein the magnetic particles have a diameter of about 2 nm to about 10 nm.

7. The method according to claim 1, wherein the permanent magnet is magnetically-levitated and self-centered within the ferrofluid.

8. The method according to claim 1, wherein the permanent magnet has a spherical shape.

9. The method according to claim 1, wherein the permanent magnet comprises Alnico, NdFeB, SmCo, FeCrCo, BaO:$Fe_2O_3$, SrO:$Fe_2O_3$, MnO:$Fe_2O_3$, Pb:$Fe_2O_3$, $Nd_2Fe_{14}B$, $Sm_2Fe_{17}N_3$, $Sm_2Co_{17}$, $SmCo_5$, $BaFe_{12}O_{19}$, or combinations thereof.

10. A method of utilizing a golf ball comprising:

providing a golf ball comprising a magnetic fluid disposed therein;

providing a magnetic medium external to the golf ball;

striking the golf ball with a golf club head while the golf ball is magnetically interacting with the magnetic medium external to the golf ball, wherein the golf ball comprises:

an inner core;

one or more mantle layers surrounding the inner core; and an outer cover surrounding the mantle layer(s), wherein the inner core is further comprised of a permanent magnet immersed in a ferrofluid, and the ferrofluid is further comprised of a colloidal suspension of nanometer-sized, single-domain, magnetic particles immersed in a carrier liquid.

11. The method according to claim 10, wherein the magnetic particles comprise ferromagnetic, anti-ferromagnetic, or ferrimagnetic substances.

12. The method according to claim 11, wherein the magnetic particles have a diameter of about 2 nm to about 10 nm.

* * * * *